US011413645B2

(12) United States Patent
Zahlen et al.

(10) Patent No.: US 11,413,645 B2
(45) Date of Patent: Aug. 16, 2022

(54) DEVICE FOR LACQUER TRANSFER

(71) Applicants: Airbus Operations GmbH, Hamburg (DE); Airbus (SAS), Blagnac (FR)

(72) Inventors: Pierre Zahlen, Stade (DE); Waldemar Kümmel, Hamburg (DE); Daniel Kress, Hamburg (DE); Christian Schepp, Hamburg (DE)

(73) Assignees: AIRBUS OPERATIONS GmbH, Hamburg (DE); AIRBUS (SAS), Blagnac (FR)

( * ) Notice: Subject to any disclaimer, the term of this patent is extended or adjusted under 35 U.S.C. 154(b) by 0 days.

(21) Appl. No.: 16/881,720

(22) Filed: May 22, 2020

(65) Prior Publication Data

US 2020/0368773 A1 Nov. 26, 2020

(30) Foreign Application Priority Data

May 23, 2019 (DE) ..... 102019113819.1

(51) Int. Cl.
*B05C 1/08* (2006.01)
*B05C 1/02* (2006.01)

(52) U.S. Cl.
CPC ..... *B05C 1/0834* (2013.01); *B05C 1/027* (2013.01); *B05C 1/0808* (2013.01); *B05C 1/0813* (2013.01)

(58) Field of Classification Search
CPC ... B05C 1/0834; B05C 1/0808; B05C 1/0813; B05C 1/027; B05C 17/0217; B05C 1/0821; B25J 11/00; B25J 11/0075; B64F 5/00
USPC ..... 118/304, 261
See application file for complete search history.

(56) References Cited

U.S. PATENT DOCUMENTS

| | | | | |
|---|---|---|---|---|
| 4,871,593 | A * | 10/1989 | McIntyre | B05C 1/0813 427/207.1 |
| 5,435,847 | A * | 7/1995 | Shibata | B05C 5/0266 118/410 |
| 6,423,144 | B1 | 7/2002 | Watanabe | |
| 6,531,025 | B1 | 3/2003 | Lender et al. | |
| 2007/0231479 | A1 | 10/2007 | Ogawa et al. | |
| 2015/0165470 | A1 | 6/2015 | Kuniyasu et al. | |

FOREIGN PATENT DOCUMENTS

| | | | |
|---|---|---|---|
| DE | 40 27 515 | 3/1991 | |
| DE | 693 16 151 | 5/1998 | |
| DE | 694 20 809 | 3/2000 | |
| WO | WO95/29765 | * 11/1995 | B05C 1/0813 |
| WO | 2015/155128 | 10/2015 | |

* cited by examiner

*Primary Examiner* — Laura Edwards
(74) *Attorney, Agent, or Firm* — Nixon & Vanderhye P.C.

(57) ABSTRACT

A device for lacquer transfer is disclosed having a frame, a transfer roller with a circumferential lateral wall, and a slit nozzle for dispensing lacquer, wherein an outside contact surface of the lateral wall includes several depressions. The transfer roller is mounted rotatably about an axis of rotation to the frame, wherein the slit nozzle is arranged for dispensing lacquer into respective depressions in the lateral wall while the transfer roller is rotated about the axis of rotation, wherein the transfer roller is configured to roll with the outside contact surface on a work surface of a work piece for transferring the lacquer from the depressions to the work surface of the work piece, wherein the slit nozzle at its muzzle end includes an upper lip and a lower lip as well as a slit between the upper and lower lips for dispensing lacquer.

8 Claims, 3 Drawing Sheets

DEVICE FOR LACQUER TRANSFER

CROSS REFERENCE TO RELATED APPLICATION

This application claims priority to and incorporates by reference German Application Number DE 10 2019 113 819.1, filed May 23, 2019.

BACKGROUND

The present disclosure relates to a device for lacquer transfer to a work surface, in particular to an aerodynamic surface of an aircraft, such as an outer surface of a wing.

The device comprises a frame, a transfer roller with a circumferential lateral wall, and a nozzle in the form of a slit nozzle with a muzzle end for dispensing lacquer. The slit nozzle is directly or indirectly connected to the frame. An outside contact surface of the lateral wall comprises several depressions. The transfer roller is mounted rotatably about an axis of rotation at the frame. The slit nozzle is arranged contactless to or in direct contact with the outside contact surface of the lateral wall for dispensing lacquer into respective depressions in the lateral wall while the transfer roller is rotated about the axis of rotation. The transfer roller is configured to roll with the outside contact surface on a work surface of a work piece for transferring the lacquer from the depressions to the work surface of the work piece.

Further, the slit nozzle at its muzzle end comprises an upper lip remote from the work surface, and a lower lip nearer to the work surface, as well as a slit between the upper and lower lips for dispensing lacquer. The upper and lower lips may be straight and parallel to one another, so that slit has constant thickness.

A similar device for lacquer transfer is known from WO 2015/155 128 A1.

With known devices for lacquer transfer it might occur depending on the dimensions of the slit of the slit nozzle, the pressure by which lacquer is dispensed through the slit nozzle, and the rotational speed of the transfer roller, that at lateral sides of a transferred lacquer track on the work surface undesired irregularities, such as elevations or lateral spilling of transferred lacquer to an adjacent track, are formed when the lacquer is transferred.

SUMMARY

The disclosure provides a device by which the quality of lacquer transferred to the work surface can be increased.

Specifically, the slit nozzle at its muzzle end comprises lacquer guide elements limiting the slit at its lateral ends to avoid irregularities at lateral sides of a transferred lacquer track on the work surface. Such irregularities might be e.g. elevations or lateral spilling of transferred lacquer to an adjacent track. The lateral ends of the slit relate to the ends in a width direction of the slit nozzle, i.e. in a direction of extension of the slit, limiting the extension of the slit in a direction parallel to the axis of rotation of the transfer roller. By such lacquer guide elements tracks with defined, regular lateral sides lacquer can be produced on the work surface, so that the quality of lacquer transferred to the work surface is essentially increased.

The device may further comprise a hardening unit that might be connected directly or indirectly to the frame and that might be formed as a UV-light unit configured for hardening the lacquer in a contactless way by emitting UV-light. UV-light within the meaning of the present invention is any kind of UV-radiation. The hardening unit might be arranged within an interior space defined by or formed within the transfer roller. The lateral wall of the transfer roller might be transparent for UV-light. The hardening unit might be arranged such that UV-light is emitted towards the work surface upon which the lateral wall of the transfer roller rolls, to harden the lacquer preferably immediately after it being transferred to the work surface.

The device or at least its frame may be configured to be releasably connected to a handling device, such as a robot with a robot arm. The frame may be configured to be releasably connected to the robot arm. Thus, the device may be a mobile device, in particular a mobile mechanical device.

The frame may form the bases of the device, since the slit nozzle and the hardening unit are each at least indirectly connected to the frame. For this purpose, the device may comprise further connecting means for connecting the slit nozzle to the frame and/or further connecting means for connecting the hardening unit to the frame. Thus, the slit nozzle and the hardening unit may be mounted to the frame. The slit nozzle may be releasably connected to the frame. Thus, the slit nozzle may be disconnected form the frame, in particular for a maintenance purpose. The slit nozzle may be connected to the frame, such that the slit nozzle can be releasably locked in a working position. If this lock is released, the slit nozzle may be pivoted via a hinge, which holds the slit nozzle at the frame. Thus, the slit nozzle may then be subject to a maintenance procedure.

The transfer roller is mounted rotatably to the frame. The transfer roller can therefore rotate about the axis of rotation. For this purpose, the device may comprise a drive unit, which is configured to drive the transfer roller in a rotation direction of the transfer roller about the axis of rotation. The drive unit may also be at least indirectly connected or mounted to the frame. During use, the drive unit drives the transfer roller, such that the transfer roller rotates about the axis of rotation and roles with the contact surface on a work surface. Furthermore, the device is moved translational in parallel to the work surface, preferably by a robot arm or another handling device, while the transfer roller rotates, such that the transfer roller rolls on the work surface for transferring lacquer.

The slit nozzle may be connected via a pipe or a tube to a lacquer supply unit, which may be configured to supply the lacquer via the tube or the pipe to the slit nozzle. The lacquer can be hardened via UV-light. The lacquer supplied to the slit nozzle may be a liquid medium or a viscous medium.

According a first nozzle arrangement of the slit nozzle, the muzzle end of the slit nozzle may be arranged contactless to the outside contact surface of the lateral wall for dispensing lacquer into respective depressions.

According to an alternative second nozzle arrangement of the slit nozzle, the muzzle end of the slit nozzle is arranged in direct contact with the outside contact surface of the lateral wall for dispensing lacquer into respective depressions.

If reference is subsequently made to the slit nozzle without explicitly specifying the first or second nozzle arrangement, the corresponding explanations may, in principle, apply as exemplary embodiments to each of the two arrangements. Therefore, it may be possible to apply the respective explanations to one of the first and second nozzle arrangement or to both nozzle arrangements.

The slit nozzle is configured for dispensing lacquer into the depressions of the lateral wall of the transfer roller. The slit nozzle may also be configured for dispensing lacquer onto depression-free sections of the lateral wall of the transfer roller. Thus, the slit nozzle may be configured for dispensing a lacquer film onto the lateral wall of the transfer roller, wherein the lacquer of the lacquer film fills the depressions and the lacquer film extends in axial direction and partly in circumferential direction of the transfer roller. The lacquer film may therefore theoretically divide into a depression part, which fills the depressions, and a remaining part, which is also referred to as bulk or a bulk part. Therefore, the transfer roller may be configured to roll with the contact surface of the transfer roller on a work surface of a work piece for transferring the lacquer from the contact surface to the work surface of the work piece, such that the lacquer film is transferred to the work surface. This encompassed the transfer of the lacquer from the depressions, but also the transfer of the bulk part. If the transfer of the lacquer from the depressions to the work surface, in particular to a surface of a wing, is described in the following, this shall preferable not exclude the possible transfer of the bulk part to the respective surface and/or the possible transfer of the lacquer from the depressions via the lacquer film.

Resulting from the direct contact between the muzzle end of the slit nozzle and the outside surface of the lateral wall of the transfer roller, preferably if the slit nozzle is in the second nozzle arrangement, a desired fill level of the depressions may be ensured and/or a desired mean thickness of the lacquer film may be ensured. However, a resulting contact force and/or a resulting contact friction should not change as much as possible during a rotation of the transfer roller in order to prevent a slip-stick-effect.

But a desired fill level of the depression may also be ensured and/or a desired mean thickness of the lacquer film on the outside surface of the lateral wall may be ensured, if the muzzle end of the slit nozzle is arranged contactless to the outside contact surface of the lateral wall, in particular, if the slit nozzle is arranged according to the first nozzle arrangement. A distance formed by the gap between the slit nozzle and the outside contact surface at the second deformation section may be predefined by an arrangement of the slit nozzle according to the second nozzle arrangement, such that lacquer dispensed by the slit nozzle continuously forms the lacquer film on the on the outside surface of the lateral wall, preferably with a predefined thickness. The dispensed lacquer therefore fills the aforementioned gap with the lacquer. As an effect, lacquer also fills the depressions of the outside contact surface at the second deformation section of the lateral wall. As a further effect, a bulk part may also be applied to the outside contact surface at the second deformation section of the lateral wall.

According to an exemplary embodiment, the lacquer guide elements at their sides facing each other comprise sharp edges for forming a lacquer track with defined, regular lateral sides. The sharp edges do not allow lacquer elevations or lateral spilling of lacquer during lacquer transfer.

According to another exemplary embodiment, the upper lip projects further in the direction to the transfer roller, preferably further in the direction to the axis of rotation of the transfer roller, than the lower lip. In such a way, a gap is formed between the lower lip and the outside contact surface of the transfer roller for the lacquer layer transferred to the transfer roller to pass through.

In particular, the lacquer guide elements may project further in the direction to the transfer roller than the lower lip. The lacquer guide elements, more preferred the sharp edges of the lacquer guide elements, may project as far as the upper lip in the direction to the transfer roller. In such a way, lacquer cannot escape laterally to form irregularities at the lateral sides of the lacquer transferred to the transfer roller.

According to an exemplary embodiment, the slit nozzle comprises an upper part including the upper lip, a lower part including the lower lip, and a spacer device arranged between the upper and lower parts and defining the distance between the upper and lower parts, and thus the thickness of the slit. The spacer device comprises side walls limiting the slit at its lateral ends. The lacquer guide elements are formed as extensions of the side walls in the direction to the transfer roller. In such a way, the lacquer guide elements do not need to be provided separately but can be provided by the existing spacer device and can be adapted to the dimensions of the spacer device.

According to another exemplary embodiment, the lacquer guide elements have a cubic shape, preferably with the sharp edges pointing to one another and to the transfer roller. Such cubic lacquer guide elements can be formed and integrated in a very simple manner.

According to another exemplary embodiment, the lacquer guide elements have a plate shape, such as a sheet shape or a panel shape. Such plate-shaped lacquer guide elements can be formed and integrated in a very simple manner.

Independent from the shape the lacquer guide elements might be formed from a flexible material, such as a flexible plastic or rubber material, or might be formed from a rigid material, such as a metal material. A flexible material might be advantageous to provide a resilient contact with the transfer roller, while a rigid material might be advantageous to produce to control the lateral sides of a transferred lacquer track even better.

BRIEF DESCRIPTION OF THE DRAWINGS

Further features, advantages and application possibilities of the present invention may be derived from the following description of exemplary embodiments and/or the figures. Thereby, all described and/or visually depicted features for themselves and/or in any combination may form an advantageous subject matter and/or features of the present invention independent of their combination in the individual claims or their dependencies. Furthermore, in the figures, same reference signs may indicate same or similar objects.

In the accompanying drawings, like reference characters refer to the same or similar parts throughout the different views. The drawings are not necessarily to scale, emphasis instead being placed upon illustrating particular principles, discussed below.

DETAILED DESCRIPTION OF SOME EMBODIMENTS

Some embodiments will now be described with reference to the Figures.

Figure 1:
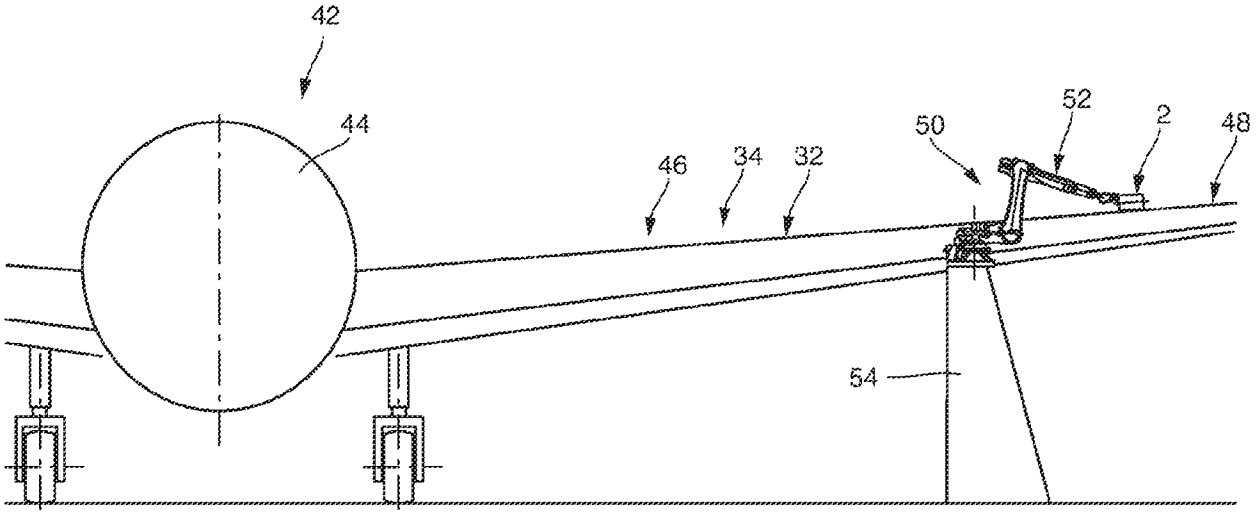
FIG. 1 schematically illustrates a part of an aircraft wherein a device arranged for transferring lacquer on an upper wing surface.

FIG. 1 schematically illustrates an aircraft 42, which comprises a fuselage 44 and a wing 46. The air resistance of the aircraft 42 can be reduced, if the upper wing surface 48 of the wing 46 comprises a profile structure. It has been found of advantage, if this profile structure is a microstructure.

FIG. 1 also schematically shows a robot 50, which is seated on a rack 54. The robot 50 comprises a movable robot arm 52. A device 2 is mounted at an end of the robot arm 52, such that the device 2 can be moved by the robot 50.

The device 2 is configured for transferring a lacquer onto a work surface 32 of a workpiece 34. According to the example shown in FIG. 1, the workpiece 34 can be formed by the wing 46 of the aircraft 42. Thus, the upper wing surface 48 can form the work surface 32.

Figures 2A, 2B:
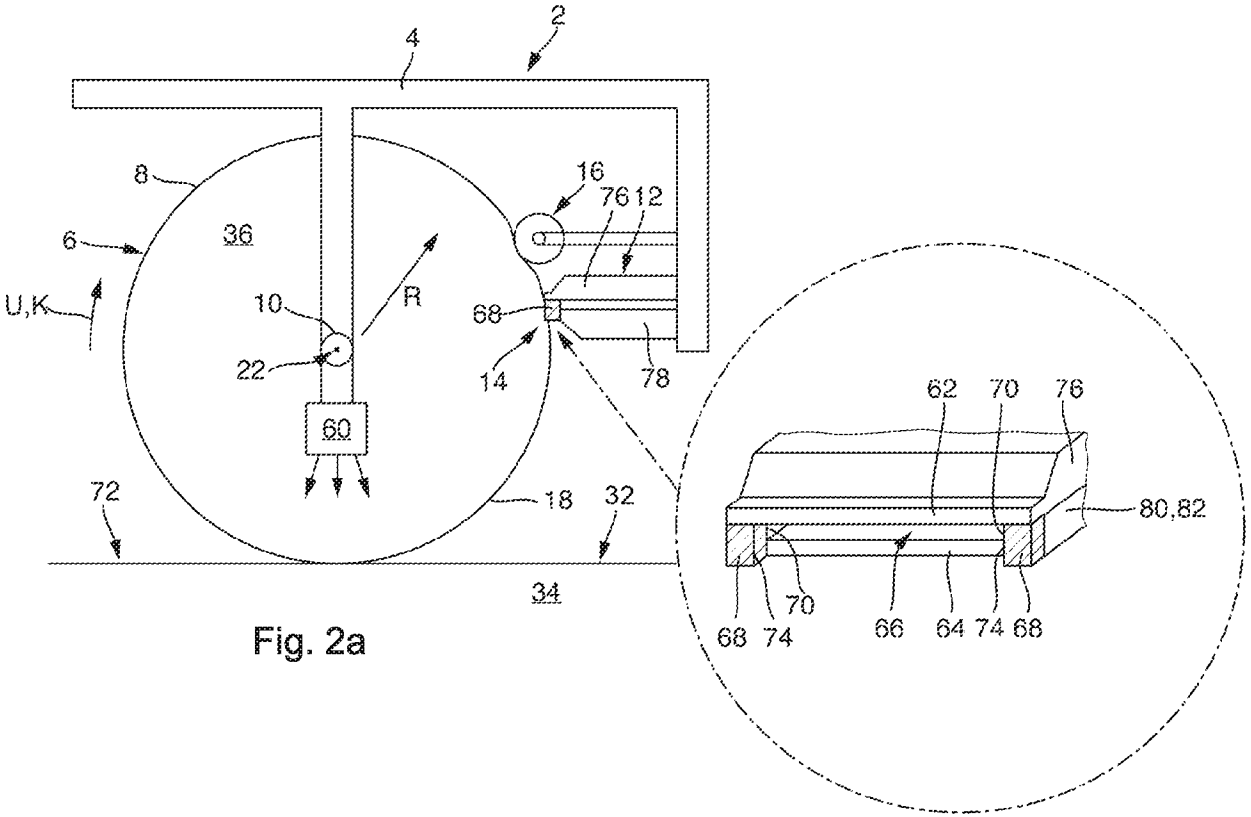
FIG. 2*a* schematically illustrates an embodiment of the device in a cross-sectional view.
FIG. 2*b* illustrates a perspective detailed view of the muzzle end of the slit nozzle.

A first embodiment of the device 2 is schematically illustrated in FIGS. 2*a* and 2*b* in a cross-sectional view. The device 2 comprises a frame 4, a transfer roller 6 with a circumferential lateral wall 8, a drive unit 10, a slit nozzle 12 with a muzzle end 14 for dispensing lacquer, and a deformation unit 16. The transfer roller 6 may also be referred to as a transfer tire. The device 2 can be attached via the frame 4 to the robot arm 52. However, instead of a robot 50 any other handling device may also be used, which is configured to move the device 2 in space. The frame 4 may be adapted to be releasably connected to a handling device, such as the robot 50.

The transfer roller 6 is mounted rotatably, in particular by means of at least one bearing, about an axis of rotation 22 at the frame 4. An outside contact surface 18 of the lateral wall 8 comprises several depressions 20. The depressions 20 may be evenly or stochastically distributed about the circumference of the lateral wall 8. The FIGS. 3 and 4 show a part of the transfer roller 6 in a cross-section view and a top view, respectively.

Figure 3:
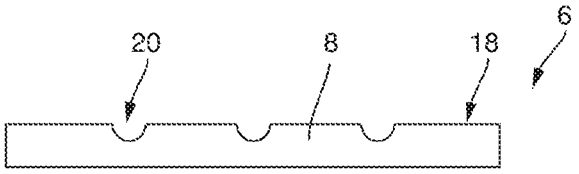
FIG. 3 schematically illustrates a part of the lateral wall of the transfer roller in a cross-sectional view.

As schematically indicated in FIG. 3, the depressions 20 can be formed by recesses arranged at the outside surface 18 of the lateral wall 8 of the transfer roller 6. The depressions 20 can have a predefined size and/or structure. A mean structure size of the depressions 20 can be in the range of 0.1 micrometer to 100 micrometer. In other words, each of the depressions 20 may have a microstructure.

Figure 4:
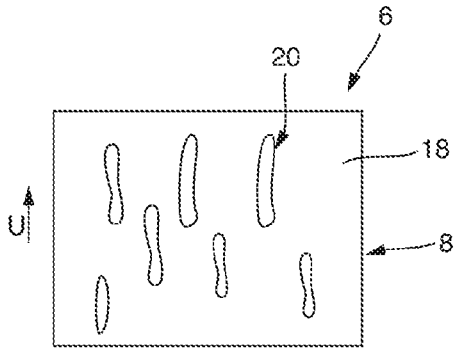
FIG. 4 schematically illustrates a further embodiment of the lateral wall of the transfer roller in a top view.

FIG. 4 exemplarily shows the depressions 20 of a part of the lateral wall 8 of the transfer roller 6 in a top view. Each of the depressions 20 may comprise an elongated extension in a circumferential direction U of the lateral wall 8 of the transfer roller 6.

Each of the depressions 20 is configured to receive lacquer and to transfer this received lacquer to a work surface 32 of a work piece 34, such as the upper wing surface 48 of a wing 26. Therefore, the several depressions 20 at the outside contact surface 18 of the lateral wall 8 may be arranged and/or formed according to a predefined structure, in particular a microstructure. The lateral wall 8 may be made of silicone, such that a damage of the wing surface 48 can be prevented.

If the depressions 20 are filled with a lacquer and if the outside contact surface 18 comes into contact with the work surface 32, in particular the upper wing surface 48, the lacquer previously received in the depressions 20 is transferred to the work surface 32, in particular the upper outside surface 48 of the aircraft 42. This transferred lacquer has a structure, in particular microstructure, corresponding to a structure defined by depressions 20. Thus, the outside contact surface 18 with its depressions 20 is configured for embossing a lacquer-structure, in particular a lacquer-microstructure, on the work surface 32, in particular the upper wing surface 48.

As schematically illustrated in FIGS. 2*a* and 2*b*, the slit nozzle 12 is directly or indirectly connected to the frame 4. Thus, the slit nozzle 12 may be mounted to the frame 4. Furthermore, the deformation unit 16 is directly or indirectly connected to the frame 4. For instance, the deformation unit 16 may be mounted on the frame 4. According to an example not illustrated in FIGS. 2*a* and 2*b*, the slit nozzle 12 and the deformation unit 16 may be formed by an integrated unit. But the slit nozzle 12 may also be directly connected to the deformation unit 16, or vice versa. Thus, the slit nozzle 12 and the deformation unit 16 may be mounted in series to the frame 4.

The device 2 also comprises the drive unit 10. The drive unit 10 is configured to drive the transfer roller 6 in a rotation direction K about the axis of rotation 22.

The lateral wall 8 of the transfer roller 6 is elastically deformable in a radial direction R of the transfer roller 6. The lateral wall 8 of the transfer roller 6 can be made of an elastomer plastic, a silicone or any other elastically deformable plastic material. The lateral wall 8 of the transfer roller 6 may be made of a synthetic, elastically deformable silicone. As a result, the lateral wall 8 can be at least sectionwise deformed in positive or negative radial direction R. The deformation unit 16 is configured to deform the lateral wall 8 in the radial direction R of the transfer roller 6 upstream from the slit nozzle 12 to provide a stable distance of the lateral wall 8 to the muzzle end 14 of the slit nozzle 12 for a defined application of lacquer to the outside contact surface 18 of the lateral wall 8. If references made to the radial direction R, this may refer to the positive radial direction R or an opposite negative radial direction.

The device 2 further comprises a hardening unit 60. The hardening unit 60 is configured for hardening the lacquer in a contactless way. The hardening unit 60 is formed by an UV-light unit. The hardening unit 60 is directly or indirectly connected to the frame 4. Moreover, the hardening unit 60 is arranged within the interior space 36 formed by the transfer roller 6. The lateral wall 8 of the transfer roller 6 is configured to transmit UV-light-waves. Thus, the lateral wall 8 is transparent for UV-light. The hardening unit 60 is arranged, such that UV-light is emitted towards the work surface 32 upon which the lateral wall 8 of the transfer roller 6 rolls. The lacquer is hardenable via UV-light. Therefore, the device is configured to control the drive unit 10 and/or the hardening unit 60 such that lacquer transferred to the work surface 32 is immediately hardened via UV-light emitted by the hardening unit 60.

As shown in FIG. 2, the slit nozzle 12 at its muzzle end 14 comprises an upper lip 62 remote from the work surface 32, and a lower lip 64 nearer to the work surface 32, as well as a slit 66 between the upper and lower lips 62, 64 for dispensing lacquer. The upper and lower lips 62, 64 are straight and parallel to one another, so that slit 66 has constant thickness. The slit nozzle 12 at its muzzle end 14 comprises lacquer guide elements 68 limiting the slit 66 at its opposite lateral ends 70 to avoid irregularities at lateral sides of a transferred lacquer track 72 on the work surface 32.

The lacquer guide elements 68 have a cubic shape and at their sides facing each other and facing the transfer roller have sharp edges 74 for forming a lacquer track 72 with defined, regular lateral sides.

The upper lip 62 of the slit nozzle 12 projects further in the direction to the transfer roller 6 than the lower lip 64. The lacquer guide elements 68, specifically the sharp edges 74 of the lacquer guide elements 68, project as far as the upper lip 62 in the direction to the transfer roller 6.

Further, the slit nozzle 12 comprises an upper part 76 including the upper lip 62, a lower part 78 including the lower lip 64, and a spacer device 80 arranged between the upper and lower parts 76, 78 to define the distance between the upper and lower parts 76, 78, and thus the thickness of the slit 66. The spacer device 80 comprises side walls 82 limiting the slit 66 at its lateral ends 70. The lacquer guide elements 68 are formed as extensions of the side walls 82 in the direction to the transfer roller 6.

It is additionally pointed out that "comprising" does not rule out other elements, and "a" or "an" does not rule out a multiplicity. It is also pointed out that features that have been described with reference to one of the above exemplary embodiments may also be disclosed as in combination with other features of other exemplary embodiments described above. Reference signs in the claims are not to be regarded as restrictive.

While at least one exemplary embodiment is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for lacquer transfer, comprising a frame, a transfer roller with a circumferential lateral wall, and a slit nozzle with a muzzle end for dispensing lacquer, wherein the slit nozzle is connected to the frame, wherein an outside contact surface of the lateral wall comprises several depressions, wherein the transfer roller is mounted rotatably about an axis of rotation to the frame, wherein the slit nozzle is arranged contactless to or in direct contact with the outside contact surface of the lateral wall for dispensing lacquer into respective depressions in the lateral wall while the transfer roller is rotated about the axis of rotation, wherein the transfer roller is configured to roll with the outside contact surface on a work surface of a work piece for transferring the lacquer from the depressions to the work surface of the work piece, wherein the slit nozzle at its muzzle end comprises an upper lip and a lower lip as well as a slit between the upper and lower lips for dispensing lacquer, wherein the slit nozzle at its muzzle end comprises a pair of lacquer guide elements limiting the slit at its opposite lateral ends to avoid irregularities at lateral sides of a transferred lacquer track, and a hardening UV-light unit mounted to the frame within an interior space formed by the transfer roller.

2. The device according to claim 1, wherein the lacquer guide elements at their sides facing each other comprise sharp edges.

3. The device according to claim 1, wherein the upper lip projects further in the direction to the transfer roller than the lower lip.

4. The device according to claim 3, wherein the lacquer guide elements project further in the direction to the transfer roller than the lower lip.

5. The device according to claim 4, wherein the lacquer guide elements project as far as the upper lip in the direction to the transfer roller.

6. The device according to claim 1, wherein the slit nozzle comprises an upper part including the upper lip, a lower part including the lower lip, and a spacer device arranged between the upper and lower parts and defining the distance between the upper and lower parts, and wherein the spacer device comprises side walls limiting the slit at its lateral ends, and wherein the lacquer guide elements are formed as extensions of the side walls in the direction to the transfer roller.

7. The device according to claim 1, wherein the lacquer guide elements have a cubic shape.

8. The device according to claim 1, wherein the lacquer guide elements have a plate shape.

* * * * *